US006989813B2

(12) United States Patent
Komiya et al.

(10) Patent No.: US 6,989,813 B2
(45) Date of Patent: Jan. 24, 2006

(54) ACTIVE MATRIX DISPLAY DEVICE

(75) Inventors: Naoaki Komiya, Kobe (JP); Masahiro Okuyama, Inazawa (JP); Koji Hirosawa, Gifu-ken (JP); Shoichiro Matsumoto, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 205 days.

(21) Appl. No.: 10/011,542

(22) Filed: Dec. 3, 2001

(65) Prior Publication Data

US 2002/0084963 A1 Jul. 4, 2002

(30) Foreign Application Priority Data

Dec. 7, 2000 (JP) ..... 2000-372836

(51) Int. Cl.
*G09G 3/36* (2006.01)

(52) U.S. Cl. ..... 345/100; 345/87; 345/98; 345/559

(58) Field of Classification Search ..... 345/87, 345/89, 92, 98, 99–100, 211, 212
See application file for complete search history.

(56) References Cited

U.S. PATENT DOCUMENTS 6,157,361 A * 12/2000 Kubota et al. ..... 345/100
6,166,726 A * 12/2000 Uchida et al. ..... 345/211
6,229,513 B1 * 5/2001 Nakano et al. ..... 345/99
6,373,460 B1 * 4/2002 Kubota et al. ..... 345/100
6,392,628 B1 * 5/2002 Yamazaki et al. ..... 345/98
6,525,710 B1 * 2/2003 Kwon ..... 345/100
6,670,944 B1 * 12/2003 Ishii ..... 345/100

FOREIGN PATENT DOCUMENTS

JP 10-207429 8/1998
JP 2000-235374 8/2000

* cited by examiner

*Primary Examiner*—Regina Liang
*Assistant Examiner*—Duc Q Dinh
(74) *Attorney, Agent, or Firm*—Sheridan Ross PC

(57) ABSTRACT

A low power-consumption active matrix display device including gate lines, drain lines, and pixel electrodes, which are arranged at intersections between the gate lines and the drain lines. A drain line driver is connected to the drain lines to select a drain line and provide the selected drain line with an image signal. A gate line driver is connected to the gate lines to select a predetermined gate line and provide the selected gate line with a gate signal. Level shifters are connected to the drain line driver to operate in a time-dividing manner. Each level shifter supplies the drain line driver with a boosted voltage.

4 Claims, 6 Drawing Sheets

ACTIVE MATRIX DISPLAY DEVICE

BACKGROUND OF THE INVENTION

The present invention relates to an active matrix display device having a plurality of pixels, each having a switching element, and more particularly, to a drive circuit of a display device that is arranged near a display area.

Display devices may be divided into passive matrix display devices and active matrix display devices. An active matrix display device has a plurality of pixels, each of which includes a switching element. The switching element applies a voltage (or supplies a current), which corresponds to image data, to the associated pixel to form an image.

In a liquid crystal display (LCD) device, liquid crystal is sandwiched between opposing substrates. A voltage is applied to pixel electrodes, which are associated with the pixels, to alter the transmittance of the liquid crystal and form an image. An active matrix LCD device is used as a monitor.

In an electroluminescence (EL) display device, current is flowed from pixel electrodes, which are associated with the pixels, to corresponding EL elements to form an image. Research is presently being carried out to put an active matrix EL display device to practical use.

A thin film transistor (TFT) is used as the switching element. To fabricate a TFT semiconductor layer without having to perform a high-temperature process, a so-called low-temperature polysilicon TFT has been proposed. In this case, the TFT is formed after the formation of various types of peripheral circuits on a glass substrate. This decreases the number of drive ICs connected around the display panel and decreases manufacturing costs. The low polysilicon TFT may be employed in active matrix display devices other than the LCD device and the EL display device, such as a plasma display and a field effect display (FED).

FIG. 1 is a schematic block diagram of a prior art active matrix LCD device 500. The LCD device 500 is formed on a glass substrate and includes an LCD panel 100, which has various peripheral circuits, and an external control circuit 200, which is connected to the LCD panel 100.

The external control circuit 200 provides the LCD panel 100 with control signals, image signals, and a power supply voltage VDD to operate the LCD panel 100. The external control circuit 200 is a CMOS circuit and is operated by a low voltage, such as 3V, and generates control signals having amplitudes of 3V.

The LCD panel 100 includes a display area 10 and various peripheral circuits. The display area 10 includes an arrangement of rows and columns of pixel electrodes 11, drain lines 12 extending along the columns of the pixel electrodes 11, and gate lines 13 extending along the rows of the pixel electrodes 11. A selection transistor 14 is arranged at each intersection between the drain lines 12 and the gate lines 13. The drain of each selection transistor 14 is connected to the corresponding drain line 12, the gate is connected to the corresponding gate line 13, and the source is connected to the corresponding pixel electrode 11. A color filter of one of RGB is arranged in each pixel electrode 11 to form a color.

A drain line driver 21, which is connected to the drain lines 12, and a gate line driver 22, which is connected to the gate lines 13, are arranged near the display area 10. A potential conversion circuit 30 is connected between the external control circuit 200, the drain line driver 21, and the gate line driver 22.

The operation of the active matrix display device 500 will now be described. The gate line driver 22 sequentially selects a predetermined gate line 13 from the plurality of gate lines 13 and applies a gate voltage VG to the selected gate line. This activates the selection transistors 14 connected to the selected gate line 13. In response to a vertical start signal (vertical scan signal) VST, the gate line driver 22 selects the first gate line 13 and sequentially switches the selected gate line 13 based on the vertical clock signal VCK.

The drain line driver 21 sequentially selects a predetermined drain line 12 from the plurality of drain lines 12 to provide RGB image signals to the pixel electrode 11 via the selected drain line 12 and the selection transistors 14. The drain line driver 21 simultaneously selects one or more of the drain lines 12. In response to a horizontal start signal (horizontal scan signal) HST, the drain line driver 21 selects the first drain line 12 and sequentially switches the drain line 12 that is to be selected based on a horizontal clock signal HCK.

The potential conversion circuit 30 receives low-voltage clock signals VCKL, HCKL having amplitudes of 3V, from the external control circuit 200 and boosts the low-voltage clock signals VCKL, HCKL, for example, to 12V. This generates the vertical clock signal VCK and the horizontal clock signal HCK. Many pixel electrodes 11 are connected to each drain line 12 and each gate line 13. Thus, the LCD panel 100 cannot be operated by a low voltage of about 3V. Accordingly, the voltage of the control signals provided from the external control circuit 200 is boosted to a high voltage of 12V. The voltage boosting is necessary to reach a predetermined operating speed of the display device 500 with TFTs. The potential conversion circuit 30 includes voltage boosting level shifters 31 and a buffer 32, which increases the current driving capability. The level shifters 31 and the buffer 32 are associated with the control signals.

FIG. 2 is a schematic circuit diagram of the drain line driver 21. The drain line driver 21 includes a scanner 23 and a plurality of RGB selection circuits 24. The scanner 23 includes a plurality of series-connected shift registers 25. Each shift register 25 is provided with the horizontal clock signal HCK, the voltage of which has been boosted by the potential conversion circuit 30. Each RGB selection circuit 24 includes three drain line selection transistors 26, each of which has a gate connected to the output terminal of an associated one of the shift registers 25. The drain of each drain line selection transistor 26 is connected to one of data lines 33R, 33G, 33B. The source of each drain line selection transistor 26 is connected to an associated one of the drain lines 12.

The shift register 25*a* in the first stage is provided with the horizontal start signal HST. In response to the horizontal start signal HST, the shift register 25*a* outputs from its output terminal Q a signal having a high level for a period of one cycle of the horizontal clock signal HCK. The output signal of the shift register 25*a* activates the drain selection transistors 26Ra, 26Ga, 26Ba, and provides image signals from the data lines 33R, 33G, 33B to the drain lines 12Ra, 12Ga, 12Ba, respectively.

The output signal of the shift register 25*a* is also provided to the shift register 25*b* in the second stage. The shift register 25*b* outputs a signal having a high level for a period of next cycle of the horizontal clock signal HCK. The output signal of the shift register 25*b* activates the drain selection transistors 26Rb, 26Gb, 26Bb and provides image signals from the data lines 33R, 33G, 33B to the drain lines 12Rb, 12Gb, 12Bb, respectively. The output signal of the shift register

25*b* activates the next shift register 25*c* and sequentially selects the associated drain lines 12 in the same manner. By operating every shift register in the same manner, every pixel is provided with the image signals.

After the selection of every drain line 12 in one row is completed, the gate line driver 22 provides the next gate line 13 with the gate voltage VG during the next cycle of the vertical clock signal VCK. Then, the horizontal start signal HST is provided to the drain line driver 21 to generate an output signal having a high level from the shift register 25*a*. Like the drain line driver 21, the gate line driver 22 is a scanner including shift registers.

Since cellular phones and portable information terminals have become popular nowadays, it is required that the power consumed by display devices be low. However, the horizontal clock signal HCK is provided to every shift register 25 of the drain line driver 21. Further, the vertical clock signal VCK is provided to every shift register of the gate line driver 22. A large current driving capability is required to provide the horizontal and vertical clock signals in this manner. This inevitably increases power consumption. The amount of power consumed by the buffer 32 to obtain the required current driving capability is especially large.

SUMMARY OF THE INVENTION

It is an object of the present invention to provide a low power-consumption active matrix display device.

To achieve the above object, the present invention provides an active matrix display device including a plurality of gate lines and a plurality of drain lines. A plurality of pixel electrodes are arranged at intersections between the plurality of gate lines and the plurality of drain lines. Each of a plurality of switching elements provides the associated pixel electrode with an image signal of the associated drain line in response to a gate signal of the associated gate line. A drain line driver is connected to the plurality of drain lines to select a predetermined drain line from the plurality of drain lines and provide the selected drain line with the image signal. A gate line driver is connected to the plurality of gate lines to select a predetermined gate line from the plurality of gate lines and provide the selected gate line with the gate signal. A plurality of level shifters are connected to the drain line driver and/or the gate line driver to operate in a time-dividing manner. Each level shifter supplies the associated driver with a boosted voltage.

A further perspective of the present invention is an active matrix display device including a plurality of gate lines and a plurality of drain lines. A plurality of pixel electrodes are arranged at intersections between the plurality of gate lines and the plurality of drain lines. Each of a plurality of switching elements provides the associated pixel electrode with an image signal of the associated drain line in response to a gate signal of the associated gate line. A drain line driver is connected to the plurality of drain lines to select a predetermined drain line from the plurality of drain lines and provide the selected drain line with the image signal. A gate line driver is connected to the plurality of gate lines to select a predetermined gate line from the plurality of gate lines and provide the selected gate line with the gate signal. A plurality of first level shifters are connected to the drain line driver to operate in a time-dividing manner. Each first level shifter supplies the drain line driver with a boosted voltage. A potential conversion circuit is connected to the gate line driver. The potential conversion circuit includes a second level shifter and a buffer connected between the second level shifter and the gate line driver.

A further perspective of the present invention is an active matrix display device including a plurality of gate lines and a plurality of drain lines. A plurality of pixel electrodes are arranged at intersections between the plurality of gate lines and the plurality of drain lines. A drain line driver is connected to the plurality of drain lines to select a predetermined drain line from the plurality of drain lines and provide the selected drain line with an image signal. A gate line driver is connected to the plurality of gate lines to select a predetermined gate line from the plurality of gate lines and provide the selected gate line with a gate signal. A plurality of level shifters are connected to the drain line driver and/or the gate line driver to boost a clock signal and provide the boosted clock signal to the associated driver. The drain line driver and the gate line driver each include a plurality of shift registers at least one of which is connected to each of the level shifters. Each shift register provides the adjacent shift register with a scan signal based on the boosted clock signal. A plurality of switches are connected to the plurality of level shifters. Each of the switches selectively supplies an associated level shifter with a power supply voltage in response to the scan signal from the shift register that is connected to the associated level shifter and in response to the scan signal from the shift register connected to the level shifter that is adjacent to the associated level shifter.

A further perspective of the present invention is an active matrix display device including a plurality of gate lines and a plurality of drain lines. A plurality of pixel electrodes are arranged at intersections between the plurality of gate lines and the plurality of drain lines. A drain line driver is connected to the plurality of drain lines to select a predetermined drain line from the plurality of drain lines and provide the selected drain line with an image signal. A gate line driver is connected to the plurality of gate lines to select a predetermined gate line from the plurality of gate lines and provide the selected gate line with a gate signal. A plurality of first level shifters are connected to the drain line driver to boost a clock signal and provide the boosted clock signal to the drain line driver. The drain line driver includes a plurality of shift registers at least one of which is connected to each of the first level shifters. Each shift register provides the adjacent shift register with a scan signal bared on the boosted clock signal. A plurality of switches are connected to the plurality of level shifters. Each of the switches selectively supplies an associated first level shifter with a power supply voltage in response to the scan signal from the shift register that is connected to the associated first level shifter and in response to the scan signal from the shift register connected to the first level shifter that is adjacent to the associated first level shifter. A potential conversion circuit is connected to the gate line driver. The potential conversion circuit includes a second level shifter and a buffer connected between the second level shifter and the gate line driver.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
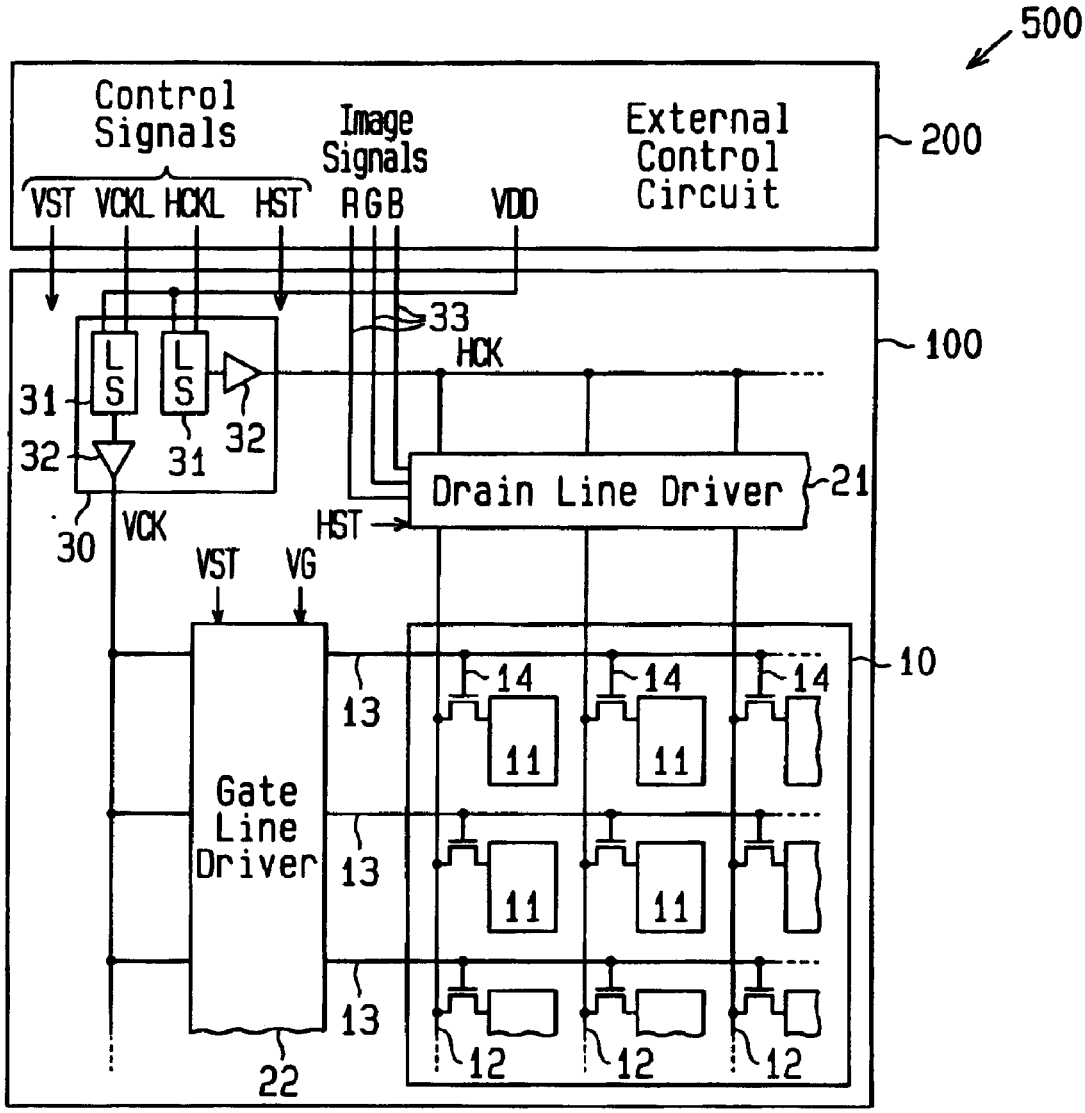
Fig.1 (Prior Art)
FIG. 1 is a schematic block diagram of a prior art active matrix display device.

In the drawings, like numerals are used for like elements throughout.

Figure 3:
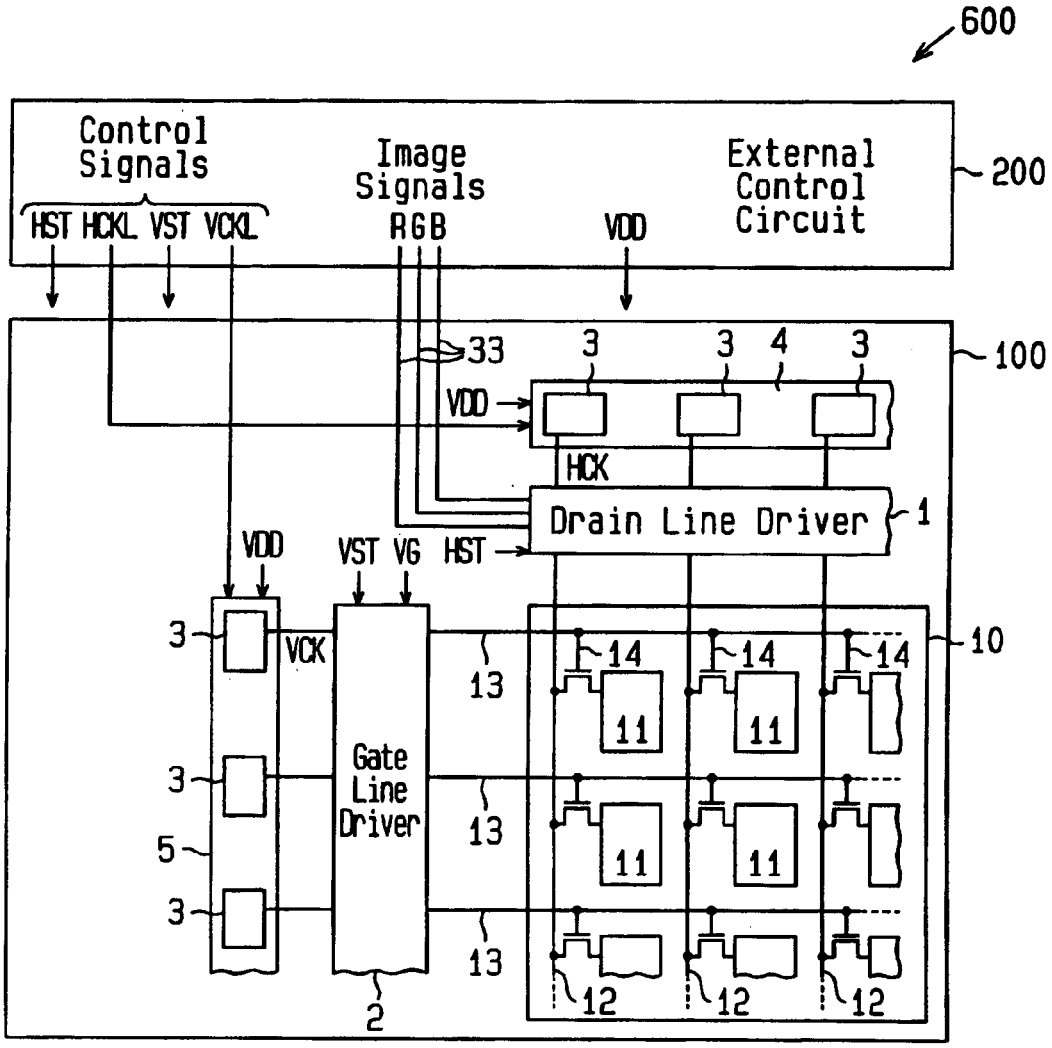
FIG. 3 is a schematic block diagram of an active matrix display device according to a first embodiment of the present invention.

FIG. 3 is a schematic block diagram of an active matrix LCD device 600 according to a first embodiment of the present invention.

The LCD device 600 includes an LCD panel 300 and an external control circuit 200, which is connected to the LCD panel 300.

A drain line driver 1, which is connected to a plurality of drain lines 12, and a gate line driver 2, which is connected to a plurality of gate lines 13, are arranged near a display area 10 of the LCD panel 300. The drain line driver 1 and the gate line driver 2 function in the same manner as the drain line driver 21 and the gate line driver 22 of FIG. 1. More specifically, in response to a vertical start signal VST, the gate line driver 2 selects a first gate line 13 and sequentially selects the following gate lines 13 based on a vertical clock signal VCK. Further, the gate line driver 2 supplies the selected gate line 13 with a gate voltage VG. In response to a horizontal start signal HST, the drain line driver 1 selects the first drain line 12 and sequentially selects the following drain lines 12 based on a horizontal clock signal HCK. Further, the drain line driver 1 provides image signals to the selected drain line 12.

The feature of the LCD device 600 in the first embodiment is in that the drain line driver 1 and the gate line driver 2 are connected to level shifter groups 4, 5, respectively. Each of the level shifter groups 4, 5 includes a plurality of level shifters 3. Each level shifter 3 operates in a time-dividing manner.

Figure 4:
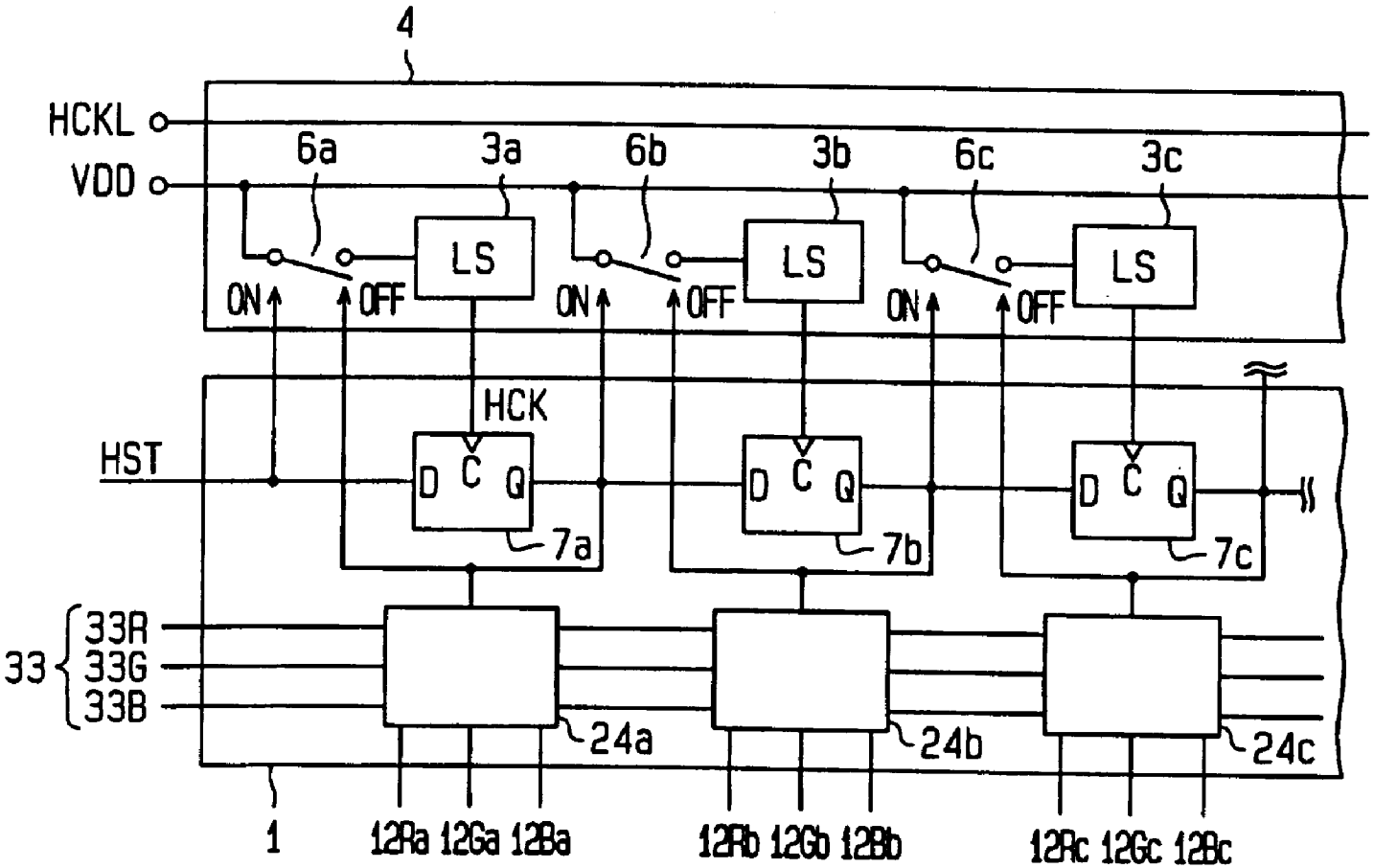
FIG. 4 is a schematic circuit diagram of a voltage conversion circuit and a drain line driver employed in the display device of FIG. 3.

FIG. 4 is a schematic circuit diagram of the drain line driver 1 and the level shifter group 4. The level shifter group 4 includes a plurality of switches 6 in addition to the level shifters 3. The drain line driver 1 includes a plurality of shift registers 7 and a plurality of RGB selection circuits 24. The level shifters 4 each have the same configuration, and the switches 6 each have the same configuration. Further, the shift registers 7 each have the same configuration, and the RGB selection circuits 24 each have the same configuration. In FIG. 4, the level shifters 3 are denoted by 3*a,* 3*b,* and 3*c,* the switches 6 are denoted by 6*a,* 6*b,* and 6*c,* the shift registers 7 are denoted by 7*a,* 7*b,* 7*c,* and the RGB selection circuits 24 are denoted by 24*a,* 24*b,* and 24*c*.

Figure 2:
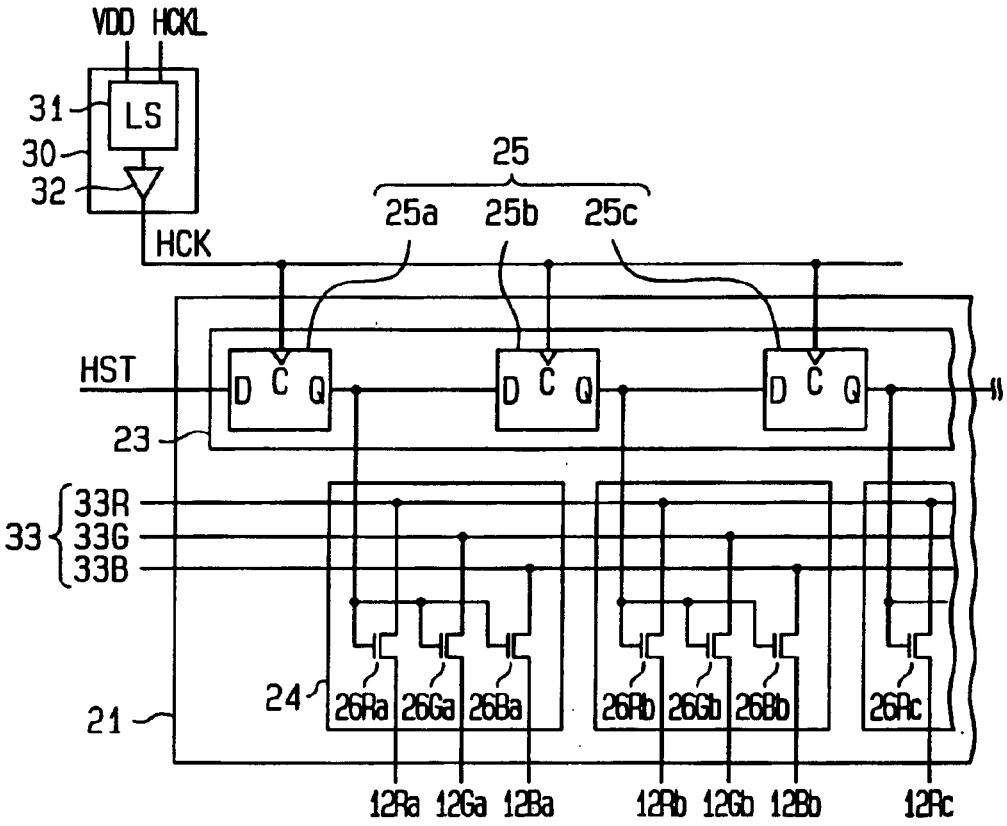
Fig.2 (Prior Art)
FIG. 2 is a schematic circuit diagram of a voltage conversion circuit and a drain line driver employed in the display device of FIG. 1.

The external control circuit 200 provides each level shifter 3 with a low-voltage clock signal HCKL, the amplitude of which is 3V. When the corresponding switch 6 goes on, the level shifter 3 is connected to a power supply VDD. This boosts the low-voltage clock signal HCKL and generates the horizontal clock signal HCK. The shift registers 7 are connected in series and form a scanner. The output signal of each shift register 7 is provided to the associated RGB selection circuit 24 and the two associated switches 6. The configuration of each RGB selection circuit 24 is the same as that of the RGB selection circuits 24 shown in FIG. 2. Further, each RGB selection circuit 24 connects the data lines 33 and the drain lines 12 in response to the output signal of the associated shift register 7.

The operation of the drain line driver 1 and the level shifter group 4 will now be described. First, the horizontal start signal HST is provided to the first stage shift register 7*a* and the switch 6*a*. The horizontal start signal HST sets the shift register 7*a,* causes the switch 6*a* to go on, and provides the power supply voltage VDD to the level shifter 3*a*. The level shifter 3*a* boosts the low-voltage horizontal clock signal HCKL and provides the boosted horizontal clock signal HCK to the shift register 7*a*. During the first cycle of the first horizontal clock signal HCK from when the shift register 7*a* is provided with the start signal HST, the shift register 7*a* generates an output signal having a high level. In response to the output signal of the shift register 7*a,* the RGB selection circuit 24*a* connects the data lines 33R, 33G, 33B to the drain lines 12Ra, 12Ga, 12Ba, respectively, and provides image signals to the drain lines 12Ra, 12Ga, 12Ba.

The output signal of the shift register 7*a* is provided to the switch 6*a,* the second stage shift register 7*b,* and the switch 6*b*. The output signal of the shift register 7*a* causes the switch 6*a* to go off and inactivates the level shifter 3*a*. Simultaneously, the output signal of the shift register 7*a* causes the shift register 7*a* to go on and activates the level shifter 3*b*. The output signal of the shift register 7*a* sets the shift register 7*b* and provides the shift register 7*b* with the horizontal clock signal HCK, which has been boosted by the level shifter 3*b*. The shift register 7*b* generates an output signal having a high level during the next cycle of the horizontal clock signal HCK and provides the image signals of the data lines 33R, 33G, 33B to the drain lines 12Rb, 12Gb, 12Bb, respectively. The output signal of the shift register 7*b* is provided to the switch 6*b* and the switch 6*b* goes off. This inactivates the level shifter 3*b*. Further, the output signal of the shift register 7*b* causes the switch 6*c* to go on and activates the level shifter 3*c* in the next stage.

In the same manner, the following level shifters 3 are activated by the output signal of the shift register 7 in the previous stage. The shift register 7 connected to the activated level shifter 3 generates an output signal, and the drain lines 12 are provided with the image signals. The output signal of the shift register 7 inactivates the activated corresponding switch 6. This operation is repeated to sequentially select the drain lines 12 and provide the image signals to every pixel.

When every drain line 12 of a single row has been selected, the gate line driver 2 supplies the next gate line 13 with the gate voltage VG during the next cycle of the vertical clock signal VCK. Further, the horizontal start signal HST is provided to the drain line driver 1 again, and the shift register 7*a* generates an output signal having a high level.

Like the drain line driver 1, the gate line driver 2 is formed by a scanner including a plurality of shift registers. Further, like the lever shifter group 4, the level shifter group 5 includes a plurality of level shifters 3 and a plurality of switches 6.

Each, level shifter 3 is activated during one cycle of the horizontal clock signal HCK and is inactivated when the level shifter 3 in the next stage is activated. That is, the level shifters 3 are activated in a time-dividing manner. Since only one shift register 7 is connected to each level shifter 3, only one shift register 7 is activated when one level shifter 3 is activated. Accordingly, this decreases power consumption in comparison to the prior art LCD device, which activates all of the shift registers 25.

Further, the clock signal boosted by the level shifter 3 is provided to only one shift register 7. Thus, the level shifter 3 is not required to have a relatively high current driving capability. Accordingly, in the first embodiment, the buffer 32 of FIG. 1 is not necessary. This further decreases power consumption.

Figure 5:
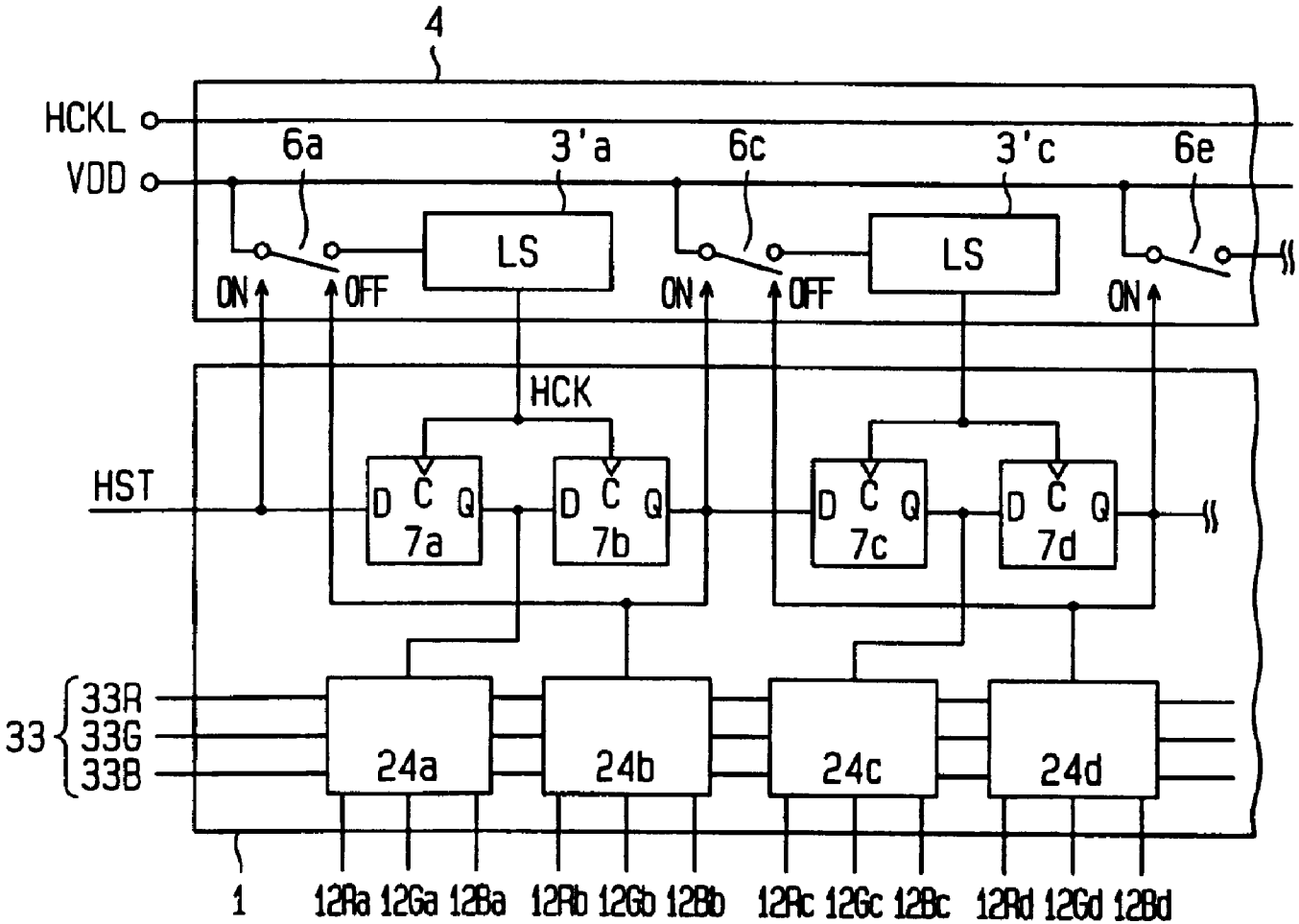
FIG. 5 is a schematic circuit diagram of a voltage conversion circuit and a drain line driver according to a second embodiment of the present invention.

An active matrix LCD device according to a second embodiment of the present invention will now be discussed. The configuration and operation of the LCD device are the same as the LCD device 600 of FIG. 3 and will thus not be discussed. In the second embodiment, the configuration of the drain line driver 1, the gate line driver 2, and the level shifter groups 4, 5 differ from that of the first embodiment. FIG. 5 is a schematic circuit diagram of the drain line driver 1 and the level shifter group 4.

The level shifter group 4 includes a plurality of level shifters 3 and a plurality of switches 6. The drain line driver 1 includes a plurality of shift registers 7 and a plurality of RGB selection circuits 24. The feature of the second embodiment is in that two shift registers 7 are allocated to one level shifter 3.

The operation of the drain line driver 1 and the level shifter group 4 will now be discussed. The horizontal start signal HST is provided to the first stage shift register 7*a* and the switch 6*a*. This sets the shift register 7*a* and causes the switch 6*a* to go on. The first level shifter 3'*a* is supplied with the power supply voltage VDD, and the level shifter 3'*a* provides the boosted horizontal clock signal HCK to the shift registers 7*a*, 7*b*. The shift register 7*a* generates an output signal having a high level during the first cycle of the horizontal clock signal HCK from when the start signal HST is provided. The output signal of the shift register 7*a* causes the RGB selection circuit 24*a* to connect the data lines 33R, 33G, 33B to the drain lines 12Ra, 12Ga, 12Ba, respectively, and provides the drain lines 12Ra, 12Ga, 12Ba with image signals.

The output signal of the first stage shift register 7*a* is provided to the second stage shift register 7*b*. The output signal of the shift register 7*b* connects the data lines 33R, 33G, 33B and the drain lines 12Rb, 12Gb, 12Bb. Unlike the first embodiment, the output signal of the shift register 7*a* is not provided to the switch 6*a*. Thus, the level shifter 3'*c* is continuously activated for two cycles of the horizontal clock signal HCK. The output signal of the shift register 7*b* provides the drain lines 12Rb, 12Gb, 12Bb with image signals. When the switch 6*a* goes off and the level shifter 3'*c* is inactivated, the switch 6*c* goes on and the level shifter 3'*c* is activated. The shift register 7*c* is set by the horizontal clock signal HCK from the level shifter 3'*c* generates an output signal having a high level during one cycle of the horizontal clock signal HCK, and provides the image signals of the data lines 33R, 33G, 33B to the drain lines 12Rc, 12Gc, 12Bc, respectively.

The output signal of the shift register 7*c* causes the shift register 7*d* to generate an output signal having a high level and provides the image signals of the data lines 33R, 33G, 33B to the drain lines 12Rd, 12Gd, 12Bd, respectively. After two cycles of the horizontal clock signal HCK, the output signal of the shift register 7*d* causes the switch 6*c* to go off and inactivates the level shifter 3'*c*. Further, the switch 6*e* goes on and the level shifter in the next stage is activated.

In the same manner, the level shifter 3 (3'*c*) is activated by the output signal of the former stage shift register 7 (7*b*) and the latter stage shift register 7 (7*c*) provides an output signal with the RGB selection circuit 24, so that the image signals are provided to the drain lines 12. Each level shifter 3 is activated during two cycles of the horizontal clock signal HCK and is inactivated when the output signal of the corresponding shift register 7 causes the corresponding switch 6 to go off. This operation is repeated to sequentially select the drain lines 12 and provide the image signals to every pixel.

In the second embodiment, each level shifter 3 is activated during two cycles of the horizontal clock signal HCK and inactivated when the level shifter 3 of the next stage is activated. That is, the level shifters 3 are activated in a time-dividing manner. In the second embodiment, two of the shift registers 7 are simultaneously activated. The power consumption of the two shift registers 7 is less than that when all of the shift registers 25 are activated in the prior art LCD device. Further, the current supply capacity of each level shifter 3 is sufficient for two shift registers 7. Accordingly, a buffer is not necessary.

In the second embodiment, two shift registers 7 are allocated to each level shifter 3. This reduces circuit area. Further, this provides enough space for the level shifters 3 even when the pixel size is reduced and the number of pixels is increased to improve the image display quality. Accordingly, the second embodiment is optimal when applied to a highly fine display device.

In the second embodiment, two shift registers 7 are allocated to one level shifter 3. However, for example, five shift registers 7 may be allocated to one level shifter 3. It is preferred that the number of the shift registers 7 allocated to each level shifter 3 be determined in accordance with the size of the level shifters 3 and the pixel size. However, if the number of level shifters 3 is overly decreased, this would increase the number of the shift registers 7 connected to each level shifter 3 and result in the current driving capacity of the level shifters 3 being insufficient. As a result, a buffer would be necessary. Further, if many shift registers 7 were simultaneously activated, power consumption would not decrease. The applicant has performed simulations and determined that the buffer 32 is not necessary when the output signal of a single level shifter 3 is provided to fifteen shift registers 7. Accordingly, it is preferred that a maximum of fifteen shift registers be allocated to each single level shifter. As long as the number of the shift registers is about fifteen, power consumption may be significantly decreased in comparison with the prior art.

From the viewpoint of the operation of the level shifter groups 4, 5, the same number of shift registers 7 does not have to be allocated to each level shifter 3. However, it is preferred that the number of shift registers 7 allocated to each level shifter 3 be the same to facilitate circuit designing.

As an example, an LCD device having a pixel number of 560 will now be described. A normal LCD device has ten dummy pixel electrodes, which do not contribute to the display, arranged on each side of the display pixel electrodes. Accordingly, in this case, 570 pixel electrodes are arranged on a single row. In such LCD device, it is preferred that fifteen pixel electrodes be allocated to each level shifter 3. Three pixel electrodes are allocated to each shift register 7. Thus, five shift registers 7 are allocated to each level shifter 3. Accordingly, 38 level shifters 3 are provided for the 570 pixel electrodes, and five shift registers 7 are connected to each level shifter 3.

As another example, an LCD device having 567 pixel electrodes, which include seven dummy pixel electrodes, will now be described. In this case, nine pixel electrodes are allocated to each level shifter (i.e., three shift registers are allocated to each level shifter), and 63 level shifters are employed. Three shift registers 7 are connected to each level shifter 3. In this manner, the number of shift registers that are connected to the level shifter 3 may be equalized by adjusting the number of dummy pixel electrodes.

Figure 6:
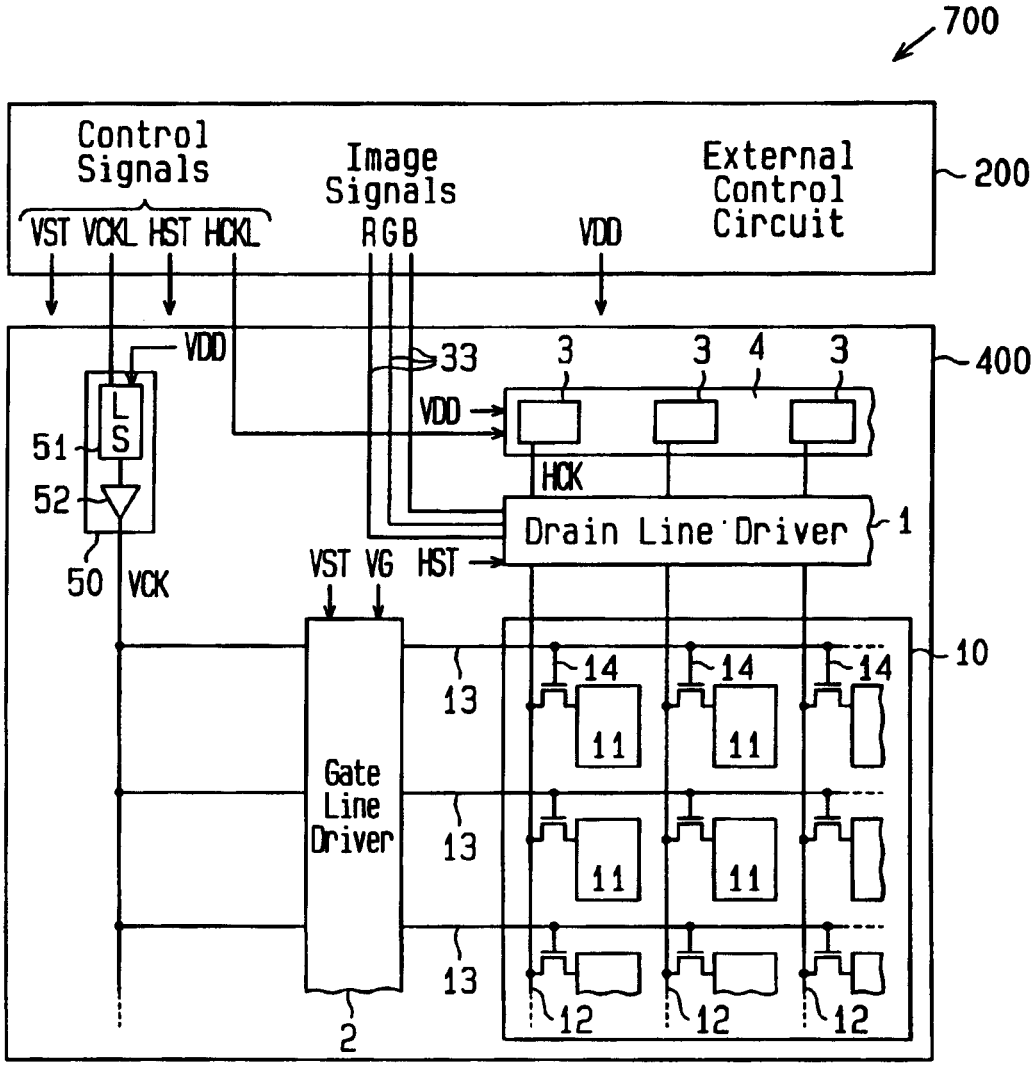
FIG. 6 is a schematic block diagram of an active matrix display device according to a third embodiment of the present invention.

The level shifters that are activated in a time-dividing manner may be applied to the gate line driver 2 in the same manner. The drain line driver 1 must be operated at a higher speed than the gate line driver 2. Thus, the power consumed by the activation of the shift registers is relatively large. Accordingly, the present invention is more effective when applied to the drain line driver in comparison to when applied to the gate line driver. In comparison, the reducing of the power consumption is effective when the level shifter groups are connected to the drain line driver than when the level shifter groups are connected to the gate line driver. Accordingly, the present invention may be embodied in an LCD device 700 having a display panel 400, as shown in FIG. 6. In the LCD device 700, a plurality of level shifters 3 are connected to the drain line driver 1 so that power consumption is decreased more effectively. Further, a potential conversion circuit 50, which includes a level shifter 51 and a buffer 52, is connected to the gate line driver 2.

It should be apparent to those skilled in the art that the present invention may be embodied in many other specific forms without departing from the spirit or scope of the invention. Particularly, it should be understood that the present invention may be embodied in the following forms.

In addition to an LCD device, the present invention may be applied to active matrix display devices, such as an EL display device, a plasma display, or a FED display.

The present examples and embodiments are to be considered as illustrative and not restrictive, and the invention is not to be limited to the details given herein, but may be modified within the scope and equivalence of the appended claims.

What is claimed is:

1. An active matrix display device comprising:

a plurality of gate lines;

a plurality of drain lines;

a plurality of pixel electrodes arranged at intersections between the plurality of gate lines and the plurality of drain lines;

a drain line driver connected to the plurality of drain lines for selecting a predetermined drain line from the plurality of drain lines and providing the selected drain line with an image signal;

a gate line driver connected to the plurality of gate lines for selecting a predetermined gate line from the plurality of gate lines and providing the selected gate line with a gate signal;

a plurality of level shifters connected to the drain line driver and/or the gate line driver, each level shifter boosting a clock signal and providing the boosted clock signal to the associated driver, wherein the drain line driver and the gate line driver each include a plurality of shift registers at least one of which is connected to each of the level shifters, and wherein each shift register provides the adjacent shift register with a scan signal based on the boasted clock signal; and a plurality of switches connected to the plurality of level shifters, wherein each switch selectively supplies an associated level shifter with a power supply voltage in response to the scan signal from the shift register that is connected to the associated level shifter and in response to the scan signal from the shift register connected to the level shifter that is adjacent to the associated level shifter.

2. The display device according to claim 1, wherein fifteen or less of the shift registers are connected to each level shifter.

3. An active matrix display device comprising:

a plurality of gate lines;

a plurality of drain lines;

a plurality of pixel electrodes arranged at intersections between the plurality of gate lines and the plurality of drain lines;

a drain line driver connected to the plurality of drain lines for selecting a predetermined drain line from the plurality of drain lines and providing the selected drain line with an image signal;

a gate line driver connected to the plurality of gate lines for selecting a predetermined gate line from the plurality of gate lines and providing the selected gate line with a gate signal;

a plurality of first level shifters connected to the drain line driver for boosting a clock signal and providing the boosted clock signal to the drain line driver, wherein the drain line driver includes a plurality of shift registers at least one of which is connected to each of the first level shifters, and wherein each shift register provides the adjacent shift register with a scan signal based on the boosted clock signal;

a plurality of switches connected to the plurality of level shifters, wherein each switch selectively supplies an associated first level shifter with a power supply voltage in response to the scan signal from the shift register that is connected to the associated first level shifter and in response to the scan signal from the shift register connected to the first level shifter that is adjacent to the associated first level shifter; and a potential conversion circuit connected to the gate line driver, wherein the potential conversion circuit includes a second level shifter and a buffer connected between the second level shifter and the gate line driver.

4. The device according to claim 3, wherein fifteen or less of the shift registers are connected to each level shifter.

* * * * *